US005265389A

United States Patent [19]

Mazzone et al.

[11] Patent Number: 5,265,389

[45] Date of Patent: Nov. 30, 1993

[54] COMPOSITE BUILDING PANEL

[75] Inventors: Mark C. Mazzone, Brecksville; Leroy Ozanne, Shaker Heights, both of Ohio

[73] Assignee: Epcore Panel Systems Inc., Cleveland, Ohio

[21] Appl. No.: 760,359

[22] Filed: Sep. 16, 1991

[51] Int. Cl.[5] ..... E04C 1/00

[52] U.S. Cl. ..... 52/309.7; 52/309.12; 52/600; 52/823; 52/826

[58] Field of Search ..... 52/309.7, 309.12, 309.4, 52/309.16, 807, 813, 815, 823, 824, 600, 601, 602, 822, 825, 826, 827

[56] References Cited

U.S. PATENT DOCUMENTS

| | | | |
|---|---|---|---|
| 2,082,235 | 6/1937 | Warren | 52/823 |
| 2,578,600 | 12/1951 | Rose | 52/309.4 |
| 3,775,920 | 12/1973 | Schneller | 52/823 X |
| 4,037,379 | 7/1977 | Ozanne | 52/404 |
| 4,078,348 | 3/1978 | Rothman | 52/309.7 |
| 4,223,500 | 9/1980 | Clark et al. | 52/309.4 |
| 4,242,848 | 1/1981 | Schoultz | 52/823 |
| 4,612,748 | 9/1986 | Arnold et al. | 52/309.16 |
| 4,624,094 | 11/1986 | Schwindt | 52/813 X |
| 4,981,003 | 1/1991 | McCarthy | 52/309.7 |
| 5,072,569 | 12/1991 | Vantassel | 52/309.12 |

FOREIGN PATENT DOCUMENTS

| | | | |
|---|---|---|---|
| 7908093 | 6/1981 | Netherlands | 52/309.4 |

*Primary Examiner*—Richard E. Chilcot, Jr.
*Assistant Examiner*—Kien Nguyen
*Attorney, Agent, or Firm*—Peter D. Sachtjen

[57] ABSTRACT

A composite building panel includes a core of a foamed polymeric insulating material, such as expanded polystyrene, having a plurality of uniformly spaced open box tubes retained in vertical grooves formed in the rear surface of the core by a two-part epoxy adhesive, the tubes being mechanically connected at their ends to one leg of continuousa horizontal channels having their other leg adhesively secured to the core at horizontal slots. The front surface of the core is continuous without seams and may be coated with a variety of exterior insulation finishing system coatings.

8 Claims, 3 Drawing Sheets

COMPOSITE BUILDING PANEL

BACKGROUND OF THE INVENTION

The present invention relates to building panels for use in construction, and, in particular, to a composite, light-weight building panel for use as an exterior curtain wall panel in commercial exterior finish and insulation systems.

Exterior finish and insulation systems ("EFIS") for exterior walls have become increasingly popular in commercial construction as alternatives to brick, stone, metal, and wood facades. The EFIS system is characterized by a foam facing, expanded polystyrene or polyurethane, which is adhered to a support substrate. The foam facing is covered by a base coat of synthetic plaster and portland cement in which a fiberglass mesh is embedded. The base coat is covered by a finish coat of synthetic plaster. The finish coat may be applied with different textures in almost unlimited colors to provide a wide variety of aesthetic appearances.

EFIS wall systems may be constructed on-site or manufactured as panels which are brought to the site as completed components and attached to the building support structure. The most common type of panel using the EFIS systems uses a steel stud and gypsum framing wall as the substrate for mounting the foam facing. More particularly, a series of uniforms spaced metal studs are connected to metal channels at the top and bottom. Gypsum sheathing is attached to the studs by conventional fasteners. The foam facing is then adhered to the sheathing by adhesives and finished as described above.

The EFIS panel may incorporate additional batt insulation between the studs and the interior finished with dry wall or the like. These panels are less expensive than other facades, result in lower construction, installation and maintenance costs, and can reduce energy consumption. However, such panels have certain disadvantageous. Although lighter than solid stone panels and like facades, these panels are quite heavy. In large sizes the weight of the panel requires lifting devices such as cranes for hoisting the panel to the desired location on the building. Moreover, the insulating value of the panels is generally only R6–R8 unless batt insulation is installed between the studs which then provides and overall R-value of about 20. However, batt insulation is prone to sagging with an inconsistent insulating value over time. Perhaps, the biggest limitation of these panels is delamination of the foam and coatings at the foam-gypsum interface. This can readily occur where moisture is able to penetrate the sheathing and over time loosen the bond between the gypsum and foam deteriorates. As a result, there can be peeling of the coated foam or complete separation from the support frame.

To overcome the above delamination problems, another approach has utilized a large foam panel having vertical grooves into which opposed pairs of rectangular tubes were adhesively connected. The tubes are connected at the top and bottom to horizontal channels by fasteners. Because the base coat does not adhere tenaciously to steel, the tubes are covered by thin strips of foam. This can present problems in finishing the panel in that the strip must be level with the front coating surface to avoid seeing the strips after the coating is applied. This can require considerable finishing labor, primarily sanding or rasping of the surface to insure that all surfaces are level. Moreover, these strips must be securely attached to avoid possible delamination, but however form a lesser difficulty than the gypsum/foam delamination referred to above.

BRIEF SUMMARY OF THE INVENTION

The present invention overcomes the above limitations of the above EFIS panels by providing a foam composite panel having a continuous, level front surface, free of gypsum and seams, to which the coating may be applied. A foam core of expanded polystyrene carries the support steel in recessed grooves on the rear surface only. No steel penetrates the front surface of the foam. The tubes are evenly laterally spaced along the width of the core and fastened top and bottom to channels overlying the top and bottom surfaces. The tubes are open box type tubes with reverse inner flanges. The tubes are chemically bonded to the surfaces of the tube to establish a composite with the foam. The resultant panel is extremely strong in both wind loading and axial loading permitting the design to be used for both curtain wall and load bearing wall applications. Because of the expanded polystyrene core a high and consistent R-value is provide which at typical thickness is R-23 or greater. The weight of the panel is approximately 40% lighter than the metal stud/gypsum panels. Panelss may be assembled in side-by-side relationship to form light weight panel of desired length. In multiple core assemblies, the top and bottom channels are continuous and align the cores to present a minimum amount of foam finishing prior to coating.

BRIEF DESCRIPTION OF THE DRAWINGS

The above and other objects and features of the present invention will become apparent upon reading the detailed description of the preferred embodiment taken in conjunction with the accompanying drawings in which.

DETAILED DESCRIPTION OF THE PREFERRED EMBODIMENTS

Figure 1:
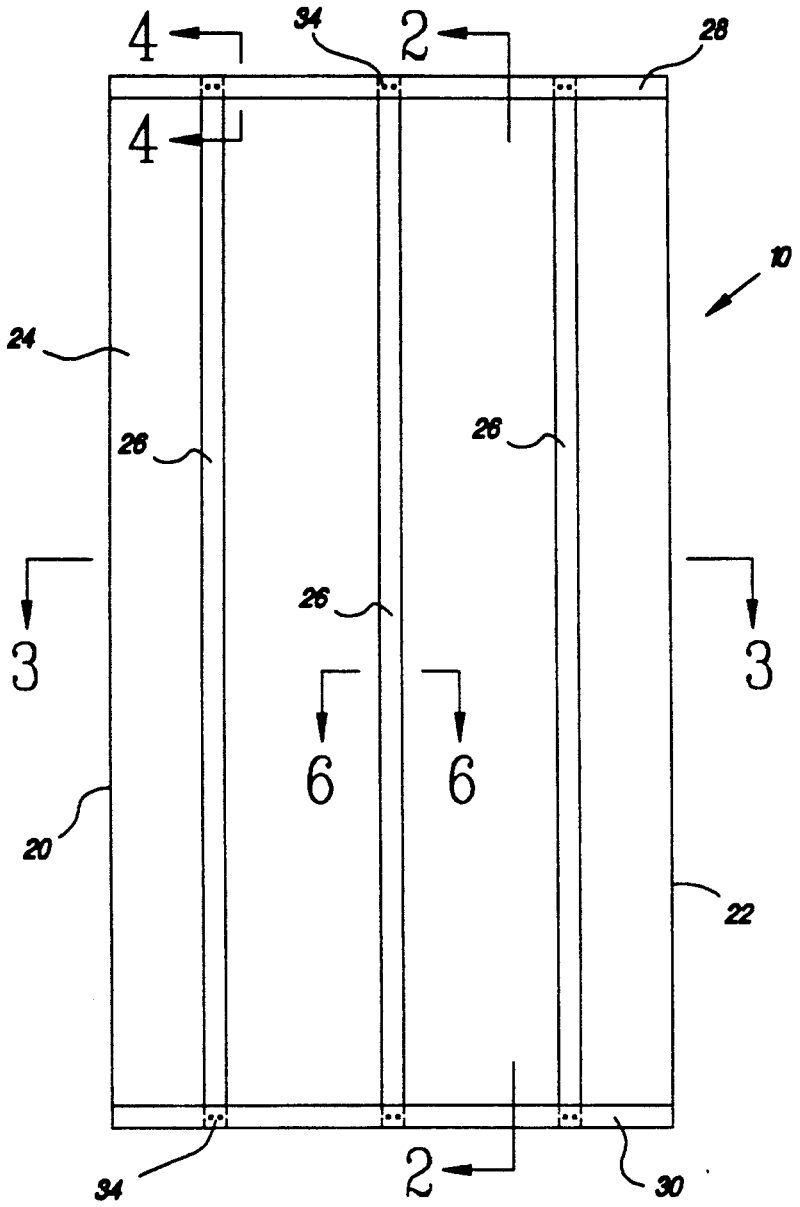
FIG. 1 is a rear elevational view of a composite building panel in accordance with the present invention.
Figure 2:
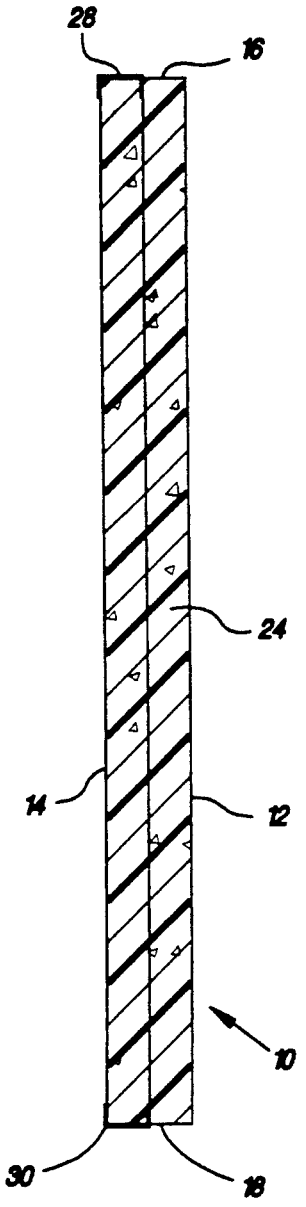
FIG. 2 is a cross sectional view of the panel taken along line 2—2 in FIG. 1.
Figure 3:
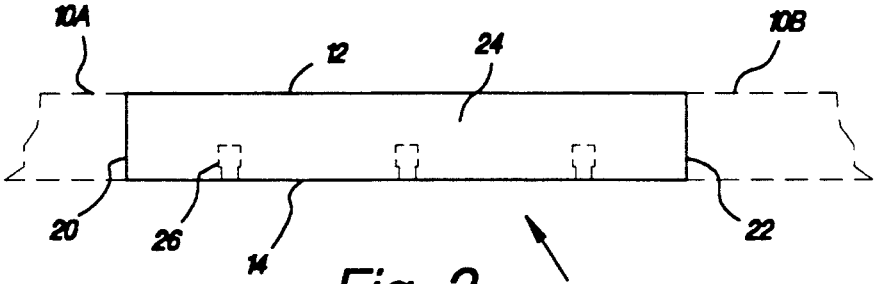
FIG. 3 is a horizontal cross sectional view of the panel taken along line 3—3 in FIG. 1.

Referring to the drawings, FIGS. 1-3 show a composite building panel 10 in accordance with the invention. The panel 10 as illustrated is substantially rectangular defined by transversely spaced front and rear walls 12 and 14, vertically spaced top and bottom walls 16 and 18, and laterally spaced end walls 20 and 22. However, it will become apparent that the panel is amenable to other configurations as defined by the peripheral walls, such as gabeled, crowned and like architectural treatment, particularly as applied to the top wall. More particularly, the panel 10 comprises a polymeric foam core 24, defined by the walls, which is structurally integrated with a plurality of vertical open-box tubes 26 to which an upper channel 28 and a lower channel 30 are attached by fasteners 34. As shown in FIG. 3, the panels and portions thereof may be assembled in side by side relationship with other panels 10A or 10B, or portions thereof to form an integrated panel of desired length.

Figure 7:
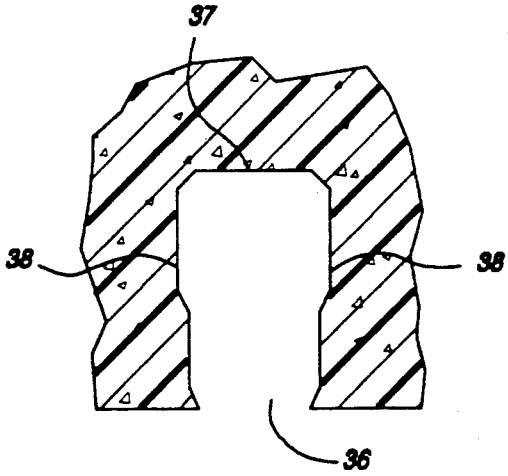
FIG. 7 is a view similar to FIG. 5 with the vertical channel removed.

As shown in FIG. 7, vertical grooves 36 are formed in the rear wall 14 of the core 24. Each groove 36 has a depth defined by a base wall 37, and a width defined by opposed side walls 38. The depth and a width of the grooves conform to the cross section of the vertical tubes 26. The grooves 36 may be formed by any conventional technique such as hot wire cutting or routing. The grooves 36 are uniformly spaced across the width of the core 24 to provice uniform on-center spacings for the tubes 26, typically 12 in., 16 in. and 24 in. As illustrated in FIG. 1, a 48 in. wide panel using 16 in. centers would have the tubes 8 in. from the side walls and one tube at the center. Thus, in assembly, the uniform tube spacing would be maintained.

Figure 6:
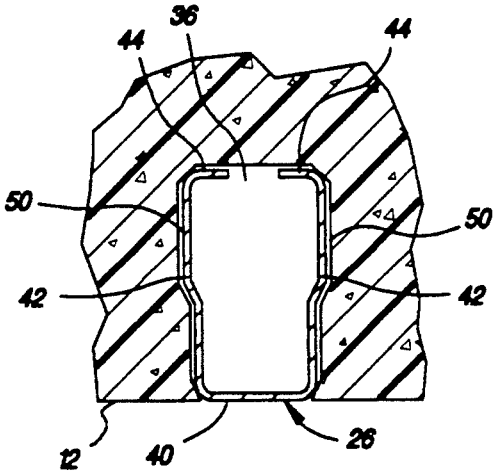
FIG. 6 is an enlarged fragmentary cross sectional view taken along line 5—5 in FIG. 1.
Figure 4:
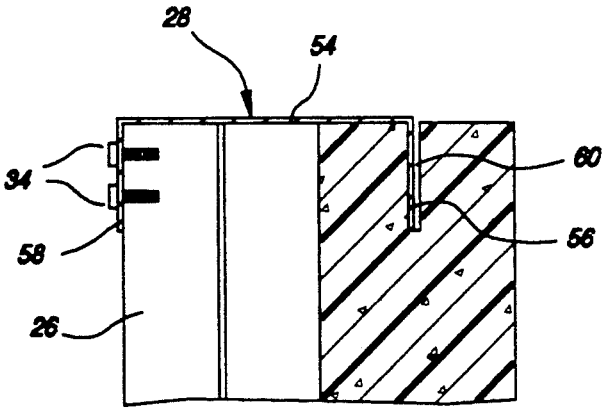
FIG. 4 is an enlarged cross sectional view taken along line 4—4 in FIG. 1.

As shown in FIG. 6, the vertical tube 26 in cross section is an open modified box tube configuration and preferably of the type disclosed in U.S. Pat. No. 4,037,379 granted on Jul. 26, 1977 to Leroy Ozanne. The tube 26 is defined by a base wall 40 coextensive and flush with the rear wall 12, a pair of rearwardly extending side walls 42 mating with the side walls 38 of the grooves 32, and inwardly turned flanges 44 adjacent the base 37 of the grooves 32. The side walls 42 of the vertical tubes 26 are structurally attached to the core 24 at the side walls of the grooves 36 by an adhesive 50. As a result the tube 26 is reinforced along its entire length, in compression by the compressive strength of the core 24 and in tension by the tensile strength of the core-/adhesive bond. The resultant composite under loading is substantially greater than the strength of the tube itself. The tubes should have a depth to width ratio of about 1.5:1 or greater. A typical tube of 20 gauge galvanized steel would have a width of about 1.625 in., a depth of about 2.815 in., and flanges of about 0.438 in.

Figure 5:
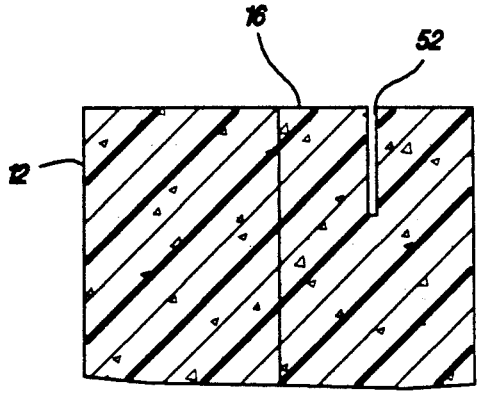
FIG. 5 is a view similar to FIG. 4 with the horizontal channel removed.

Referring to FIG. 5, the top wall 16 of the core 24 is provided with a horizontal slot 52 spaced from the rear wall 12 of the core 24 the width of the channel 28. The channel 28 has a base 54 which engages the top surface of the core 24 and a pair of depending legs 56 and 58. Leg 56 is received in slot 52 and adhered to the side walls thereof by adhesive 60. Leg 58 overlies the base 40 of the tube 26 and is attached thereto by suitable means such as self tapping fasteners 34, spot welding or other suitable means. The lower channel 30 is attached in a similar manner.

Figure 8:
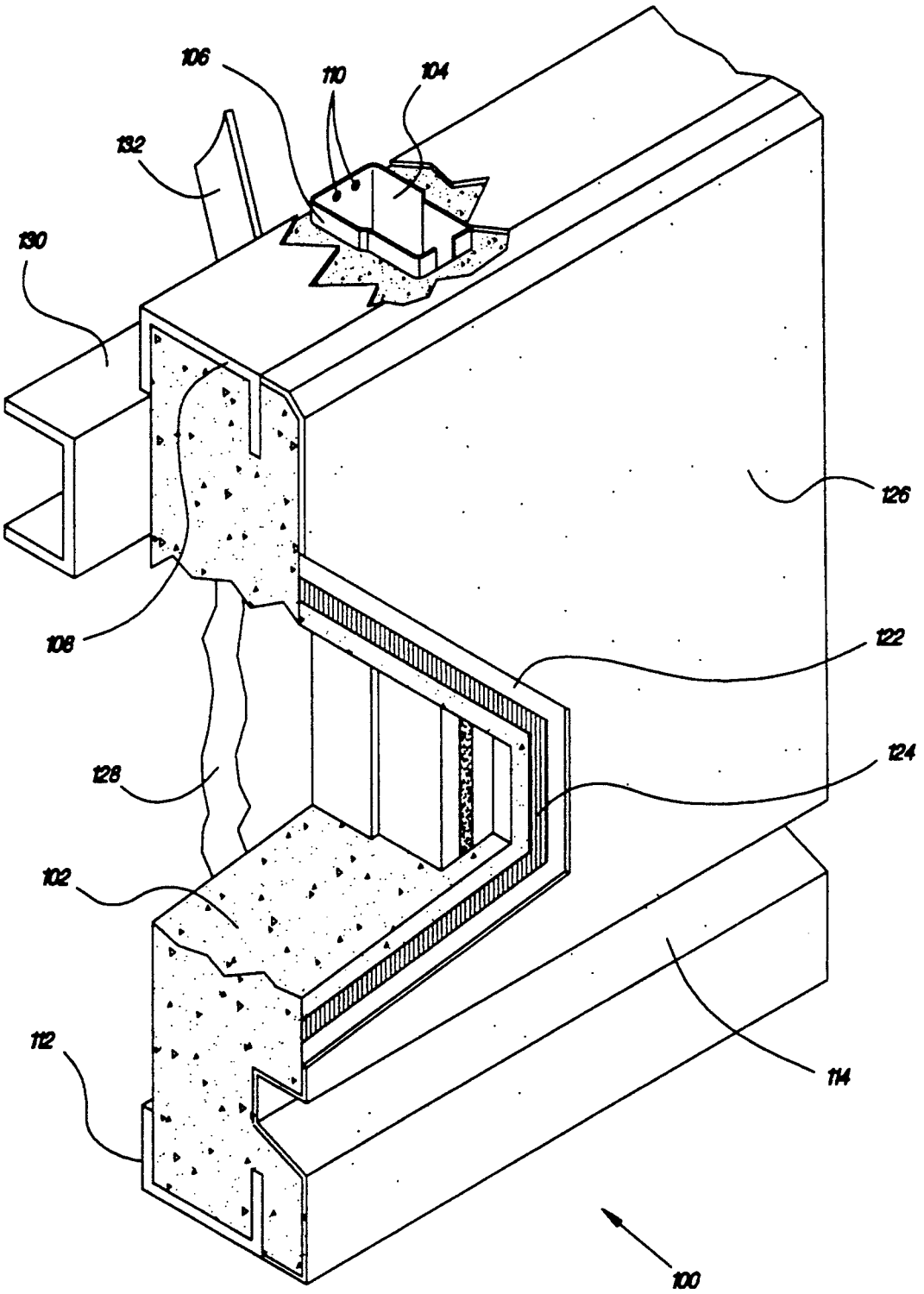
FIG. 8 is a fragmentary perspective view of another embodiment of the panel shown in FIG. 1.

The core 24 is preferably an expanded polystyrene. Depending on the loading requirements for the panel, the density of the core 24 may range from 1#/c.f. to around 2#/c.f. The thickness of the core 24 may likewise vary in accordance with the application. Typically, the thickness would be around 4 in. to 6 in., however if architectural detailing is desired such as shown in FIG. 8, greater thicknesses may be provided. As to height, the panels may be virtually any height, and, if required, may be stacked end to end. Conventional manufacturing techniques for expanded polystyrene normally limit the width to around 48 in. Accordingly if a greater panel width is desired, the panels may be assembled side-by-side as shown in FIG. 3. Preferably, the upper and lower channels would span this assembled width in a single continuous piece. However multiple pieces can be used but each piece should span at least two panels.

The upper and lower channels 28, 30 are preferably conventional light gauge galvanized steel. Depending on the loading requirements, the thickness may range from around 12 gauge to about 24 gauge. Similarly, the vertical tubes 26 are light gauge galvanized steel of similar range of thicknesses.

The adhesive used for bonding the steel components to the core is a two part epoxy system. Suitable adhesives are Emecole Product No. X8-8-71 manufactured by Lucole Inc. or PlioGrip 7600 series manufactured by Ashland Chemical Co. Other adhesives may be beneficially employed. However any such adhesive should provide secure bonding between the core and the metal components and have a peel strength greater than the shear strength of the core.

The basic panel as described above is amenable to a variety of exterior and interior finishings. FIG. 8 illustrates a synthetic finished exterior curtain wall panel of the type employed as the exterior skin of a building spanning the spacings between widows doors and other architectural detailings. Therein, the panel 100 comprises an expanded polystyrene core 102 having chemically bonded thereto vertical tubes 104 (only one being illustrated) disposed in grooves 106 as described above. An upper channel 108 overlies the vertical tube 104 on the top surface of the core 102. The inner leg of the channel 108 is structurally attached to the base of the vertical tube 104 by fasteners 110. A lower channel 112 is similarly attached to the vertical tube 104 at the base of the core 102.

The front surface of the core 102 is provided with a horizontal architectural reveal 114 which may be formed by conventional techniques. The front surface of the core 102 is clad with a conventional synthetic coating 120 comprising a cement acyrlic base coat 122, a glass fiber reinforcing mesh 124 embedded in the base coat 122, and an acrylic finish coat overlying the base coat 122. Dry wall sheeting 128 is applied to the inner face of the core 102 and attached to the vertical tubes 104 by dry wall screws (not shown). Examples of other exterior finishes which may be applied include metal cladding, ceramic tiling, wood, vinyl or any other treatment customarily used in building construction. As a typical attachment to the building framing (not shown), the panel 100 may be attached at the vertical tubes 104, by welding or fasteners, to a horizontal beam 130 structurally attached to the building, and may be additionally supported by bracing 132. Any other conventional connections may likewise be used on the steel components.

Various modifications of the above-described embodiment will become apparent to those skilled in the art. Accordingly, the scope of the invention is defined only by the accompanying claims.

What is claimed:

1. A composite building panel, comprising: a core of a foamed polymeric insulating material having transversely spaced front and rear surfaces bounded by laterally spaced end walls and vertically spaced top and bottom walls; a plurality of open box tube members, each tube member being defined by a base wall, a pair of side walls extending from the base wall, and an inwardly turned flange extending from each side wall; a plurality of rearwardly opening, laterally spaced longitudinal grooves formed in said rear surface of said core and extending between said top and bottom walls of said core, said grooves being defined by a base wall spaced from said front surface of said core and side walls spaced substantially the width of said side walls of said tube members, said grooves receiving said tube members with said flanges of said tube members engaging said base walls of said grooves; first adhesive means structurally interconnecting said tube members at said grooves; laterally extending slots formed in said top and bottom walls of said core transverse to said grooves at a predetermined distance from said base wall of said grooves and said front surface of said core; channel members having depending legs spaced at said predetermined distance, one of said legs being located in said slot and the other of said legs engaging said base wall of said tube member; second adhesive means structurally interconnecting said one of said leg members of said channel member to said core adjacent said slot; and fastening means structurally interconnecting said other of said legs of said channel members to said base walls of said tube members.

2. The composite building panel as recited in claim 1 wherein said polymeric insulating material is expanded polystyrene.

3. The composite building panel as recited in claim 2 wherein said expanded polystyrene has a density of around 1 lb./c.f. to 2 lb./c.f.

4. The building panel as recited in claim 1 wherein said base walls of said tube members are coextensive with said rear surface of said core.

5. The building panel as recited in claim 1 wherein said tube members have a side wall to base wall ratio of 1.5 or greater.

6. The building panel as recited in claim 1 wherein said front surface of said core is covered with a synthetic plaster coating.

7. The building panel as recited in claim 1 wherein said fastening means are self tapping screws.

8. The building panel as recited in claim 1 wherein said first and second adhesive means are two part epoxies.

* * * * *